US006258763B1

(12) United States Patent
Arvanitidou et al.

(10) Patent No.: US 6,258,763 B1
(45) Date of Patent: Jul. 10, 2001

(54) LIGHT DUTY LIQUID COMPOSITION CONTAINING AN ACID

(75) Inventors: Evangelia Arvanitidou, Kendall Park; Sukhvinder Sandhu, East Windsor, both of NJ (US)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/551,455

(22) Filed: Apr. 18, 2000

(51) Int. Cl.[7] ..... C11D 17/00

(52) U.S. Cl. ..... 510/221; 510/237; 510/426; 510/428

(58) Field of Search ..... 510/426, 428, 510/237, 221

(56) References Cited

U.S. PATENT DOCUMENTS 6,051,542 * 4/2000 Pollack et al. ..... 510/426

* cited by examiner

*Primary Examiner*—Necholus Ogden
(74) *Attorney, Agent, or Firm*—Richard E. Nanfeldt

(57) ABSTRACT

A light duty, liquid comprising: a paraffin sulfonate, an alpha olefin sulfonate, an acid, a sultaine surfactant, a magnesium containing inorganic compound, and water.

6 Claims, No Drawings

LIGHT DUTY LIQUID COMPOSITION CONTAINING AN ACID

BACKGROUND OF THE INVENTION

The present invention relates to novel light duty liquid detergent compositions with high foaming and good grease cutting properties as well as disinfecting properties.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid disinfecting composition which has good grease cutting properties can be formulated with a paraffin sulfonate, an alpha olefin sulfonate, a sultaine surfactant, an inorganic magnesium compound, a hydroxy aliphatic acid and water, wherein the composition has a pH of 3 to 6.

Accordingly, one object of this invention is to provide novel, high foaming, light duty liquid detergent compositions containing a hydroxy aliphatic acid.

To achieve the foregoing and other objects and in accordance with the purpose of the present invention, as embodied and broadly described herein the novel, high foaming, light duty liquid detergent of this invention comprises an alpha olefin sulfonate, a sultaine surfactant, an inorganic magnesium compound, a paraffin sulfonate, a hydroxy aliphatic acid and water wherein the composition does not contain a sulfate surfactant, a glycol ether solvent, an ethoxylated and/or propoxylated nonionic surfactant, a polyoxyalkylene glycol fatty acid, a builder, a polymeric thickener, a clay, a fatty acid alkanol amide, abrasive, silicas, tricloscan, alkaline earth metal carbonates, alkyl glycine surfactant, triethanol amine cyclic imidinium surfactant, or more than 0.2 wt. % of a perfume or water insoluble hydrocarbon and the composition does not contain an amine oxide, or an alkyl succinamate, an N-alkyl aldonamide alkylene carbonate, a pyrrolidone compound, a $C_4$–$C_{12}$ alcohol ester of sulfosuccinic acid.

DETAILED DESCRIPTION OF THE INVENTION

The present invention relates to a light duty liquid detergent which comprises approximately by weight:

(a) 3% to 18% of a paraffin sulfonate surfactant;

(b) 10% to 30% of an alpha olefin sulfonate surfactant;

(c) 0.1% to 4%, more preferably 0.5% to 3% of a magnesium inorganic compound;

(d) 5% to 15% of a sultaine surfactant;

(e) 0.05% to 2% of a hydroxy containing organic acid, sulfuric acid or hydrochloric acid; and (f) the balance being water wherein the composition does not contain a glycol ether solvent, an ethoxylated and/or propoxylated nonionic surfactant, an ethoxylated alkyl ether sulfate surfactant, a polyoxyalkylene glycol fatty acid, a builder, alkyl polyglucoside surfactant, a polymeric thickener, a clay, a fatty acid alkanol amide, abrasive, silicas, triclosan, alkaline earth metal carbonates, alkyl glycine surfactant, cyclic imidinium surfactant, or more than 0.2 wt. % of a perfume or water insoluble hydrocarbon and the composition does not contain an amine oxide having an alkyl group having 8 to 11 carbon atoms or 13 to 24 carbon atoms, an alkyl succinamate, an N-alkyl aldonamide or an alkylene carbonate.

The $C_{12}$–$C_{20}$ paraffin sulfonates used at a concentration of 3 wt. % to 18 wt. %, more preferably 4 wt. % to 14 wt. % in the instant compositions may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744 and 3,372,188 and also in German Patent 735,096. Such compounds may be made to specifications and desirably the content of paraffin sulfonates outside the $C_{14-17}$ range will be minor and will be minimized, as will be any contents of di- or poly-sulfonates.

The present invention also contains 10 wt. % to 30 wt. %, more preferably 12 wt. % to 26 wt. % of an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin.

The composition also contains about 5 to about 15 wt. %, more preferably about 7 to about 13 wt. % of a sultaine which is preferably a cocoamido-propyl dimethyl hydroxy sultaine. The sultaine can be depicted by the formula:

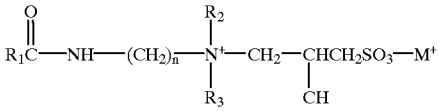

wherein $R_1$ is a saturated or unsaturated alkyl group having about 6 to about 24 carbon atoms, $R_2$ is a methyl or ethyl group, $R_3$ is a methyl or ethyl group, n is about 1 to about 6, and $M^+$ is an alkali metal cation. The most preferred hydroxysultaine is a potassium (sodium) salt of cocoamidopropyl dimethyl hydroxysultaine.

In place of the sultaine surfactant one can use a zwitterionic surfactant having the general formula:

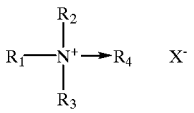

wherein $X^-$ is selected from the group consisting of $COO^-$ and $SO^{31}$ and $R_1$ is an alkyl group having 10 to about 20 carbon atoms, preferably 12 to 16 carbon atoms, or the amido radical:

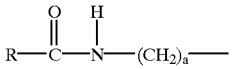

wherein R is an alkyl group having about 9 to 19 carbon atoms and a is the integer 1 to 4: $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyidimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. (A preferred betaine is coco ($C_8$–$C_{18}$) amidopropyl dimethyl betaine. Three preferred betaine surfactants are Genagen CAB and Rewoteric AMB 13 and Golmschmidt Betaine L7 (The most preferred betaine is alkyl dimethyl betaine or Genagen LAB. Other betaines of choice could be amidopropyl dimethyl or coco (C8–C18) betaine. These betaines are marketed under the names Rewoteric AMB 13, Rewoteric AMB 14U, Golmschmidt Betaine L7 and Genagen CAB).

The instant compositions contain a magnesium inorganic compound such as an inorganic or organic salt of oxide of a multivalent metal cation, particularly $Mg^{++}$. The metal salt or oxide provides several benefits including improved cleaning performance in dilute usage, particularly in soft water areas. Magnesium chloride, either anhydrous or hydrated (e.g., hexahydrate), is especially preferred as the magnesium salt. Good results also have been obtained with magnesium oxide, magnesium sulfate, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

The hydroxy containing organic acid is preferably a hydroxy aliphatic acid selected from the group consisting of lactic acid or citric acid or glycolic and mixtures thereof.

In addition to the above-described essential ingredients required for the formation of the microemulsion composition, the compositions of this invention may often and preferably do contain one or more additional ingredients which serve to improve overall product performance.

The instant compositions can optionally contain 0 to about 10 wt. %, more preferably 0.1 to 8 wt. % of a disinfectant agent selected from the group consisting of $C_8$–$C_{16}$ alkyl amines, $C_8$–$C_{16}$ alkyl benzyl dimethyl ammonium chlorides, $C_8$–$C_{16}$ dialkyl dimethyl ammonium chlorides, $C_8$–$C_{16}$ alkyl, $C_8$–$C_{14}$ alkyl dimethyl ammonium chloride and chlorhexidine and mixtures thereof. Some typical disinfectant agent useful in the instant compositions are manufactured by Lonza, S. A. They are: Bardac 2180 (or 2170) which is N-decyl-N-isonoxyl-N, N-dimethyl ammonium chloride; Bardac 22 which is didecyl dimethyl ammonium chloride; Bardac LF which is N,Ndioctyl-N, N-dimethyl ammonium chloride; Bardac 114 which is a mixture in a ratio of 1:1:1 of N-alkyl-N, N-didecyl-N, N-dimethyl ammonium chloride/N-alkyl-N, N-dimethyl-N-ethyl ammonium chloride; and Barquat MB-50 which is N-alkyl-N, N-dimethyl-N-benzyl ammonium chloride.

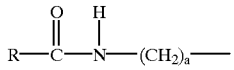

Another disinfecting agent is dimethyl benzylalkonium chloride (BASF).

The present light duty liquid detergents such as dishwashing liquids are readily made by simple mixing methods from readily available components which, on storage, do not adversely affect the entire composition. Solubilizing agent such as ethanol, sodium chloride and/or sodium cumene or sodium xylene sulfonate and mixtures thereof are used at a concentration of 0.5 wt. % to 8 wt. % to assist in solubilizing the surfactants. The viscosity of the light duty liquid composition desirably will be at least 100 centipoises (cps) at room temperature, but may be up to 1,000 centipoises as measured with a Brookfield Viscometer using a number 21 spindle rotating at 20 or 50 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is from about 3 to about 6, more preferably about 3 to about 5.5. The pH of the composition can be adjusted by the addition of $Na_2O$ (caustic soda) to the composition.

The instant compositions have a minimum foam volume of 400 mis after 40 rotations at room temperature as measured by the foam volume test using 0.0333 wt. % of the Ultra composition in 150 ppm of water. The foam test is an inverted cylinder test in which 100 gr. of a 0.0333 wt. % LDL formula in 150 ppm of $H_2O$ is placed in a stoppered graduate cylinder (500 ml) and inverted 40 cycles at a rate of 30 cycles/minute. After 40 inversions, the foam volume which has been generated is measured in mis inside the graduated cylinder. This value includes the 100 ml of LDL solution inside the cylinder. After the initial volume is measured, 175 microliters of whole milk is added to the solution. The cylinder is then inverted for another 40 cycles and a foam volume with soil is measured. The values provided above include the 100 ml's of LDL solution inside the cylinder.

The instant compositions can optionally contain 0.01 to 10 wt. % of minor ingredients such as color, perfume and polymeric thickening agents.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

EXAMPLE 1

The following formulas were prepared at room temperature by simple liquid mixing procedures as previously described

| | A (% active) | B (% active) | C (% active) | Control |
|---|---|---|---|---|
| Na alpha olefin sulfonate (C14–C16) | 20.87 | 20.87 | 20.87 | |
| Na paraffin sulfonate | 10.43 | 10.43 | 10.43 | |
| Cocoamidopropyl dimethyl hydroxy sultaine | 8.7 | 8.7 | 8.7 | |
| Magnesium chloride | 2.0 | 2.0 | 2.0 | |
| Lactic acid | 1.2 | 1.2 | 0 | |
| Sulfuric acid | | 0.28 | | |
| Water | Bal. | Bal. | Bal. | |
| pH | 3.5 | 3.5 | 7.0 | 7.0 |
| Shake Foam Initial (ml) | 441.67 | 441.67 | 440 | 433.33 |
| Shake Foam w. milk (ml) | 201 | 201 | 201.67 | 203.33 |
| UDT 10% dilution | | | | |
| S-aureus | 0/10* | 0/10 | 10/10 | 10/10 |
| E-coli | 0/10 | 0/10 | 10/10 | 10/10 |

*number of carriers found to be contaminated out of 10 carriers tested after 10 minutes contact time with the test product. (UDT/reference: AOAC, 14th Edition, 1984, Use Dilution Methods).

* number of carriers found to be contaminated out of 10 carriers tested after 10 minutes contact time with the test product. (UDT/reference: AOAC, 14th Edition, 1984, Use Dilution Methods).

What is claimed is:

1. A light duty liquid detergent composition comprising by weight:

(a) 3% to 18% of a $C_{10}$–$C_{20}$ paraffin sulfonate;

(b) 10% to 30% of an alpha olefin sulfonate;

(c) 0.1% to 4% of a magnesium containing inorganic compound;

(d) 5% to 15% of a sultaine surfactant;

(e) 0.05% to 2% of an acid selected from the group consisting of a hydroxy containing organic acid, sulfuric acid or hydrochloric acid; and (f) the balance being water, wherein the composition does not contain more than 0.2 wt. % of a water insoluble hydrocarbon and the composition has a pH of 3 to 5.5.

2. A light duty liquid composition according to claim 1 further comprising, 0.5% to 8% by weight of a solubilizing agent which is selected from the group consisting of ethanol, sodium chloride and/or a water soluble salts of $C_1$–$C_3$ substituted benzene sulfonate hydrotropes and mixtures thereof.

3. A light duty liquid composition according to claim 1 further comprising a perservative.

4. A light duty liquid composition according to claim 1 further comprising a color stabilizer.

5. A light duty liquid composition according to claim 1 further including a disinfecting agent.

6. A light duty liquid composition according to claim 1 wherein said magnesium containing inorganic compound is magnesium chloride.

* * * * *

UNITED STATES PATENT AND TRADEMARK OFFICE

CERTIFICATE OF CORRECTION

PATENT NO. : 6,258,763 B1
DATED : July 10, 2001
INVENTOR(S) : Arvaniti Dou, Evangelia, et al.

It is certified that error appears in the above-identified patent and that said Letters Patent is hereby corrected as shown below:

Title page,
Item [54], Title should read, "Light Duty Liquid Cleaning Composition Containing An Acid"

Signed and Sealed this

Twenty-ninth Day of January, 2002

*Attest:*

*Attesting Officer*

JAMES E. ROGAN
*Director of the United States Patent and Trademark Office*